US006715859B2

(12) United States Patent
Pan

(10) Patent No.: US 6,715,859 B2
(45) Date of Patent: Apr. 6, 2004

(54) THERMAL INK JET RESISTOR PASSIVATION

(75) Inventor: Alfred I-Tsung Pan, Sunnyvale, CA (US)

(73) Assignee: Hewlett -Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/873,995

(22) Filed: Jun. 6, 2001

(65) Prior Publication Data

US 2003/0007035 A1 Jan. 9, 2003

(51) Int. Cl.[7] ..... B41J 2/05
(52) U.S. Cl. ..... 347/64
(58) Field of Search ..... 347/64

(56) References Cited

U.S. PATENT DOCUMENTS

| | | | | | |
|---|---|---|---|---|---|
| 4,335,389 | A | * | 6/1982 | Shirato et al. | 347/64 |
| 4,336,548 | A | * | 6/1982 | Matsumoto | 347/64 |
| 4,528,574 | A | | 7/1985 | Boyden | |
| 5,479,197 | A | * | 12/1995 | Fujikawa et al. | 347/63 |
| 5,790,154 | A | | 8/1998 | Mitani et al. | |
| 6,064,094 | A | | 5/2000 | Intrater et al. | |
| 6,142,612 | A | * | 11/2000 | Whitman | 347/63 |
| 6,299,294 | B1 | * | 10/2001 | Regan | 347/62 |

FOREIGN PATENT DOCUMENTS

| | | | | |
|---|---|---|---|---|
| JP | 404255357 | * | 9/1992 | 347/64 |

OTHER PUBLICATIONS

Wear–Resistant Cobalt–Base Alloys, Antony, K.C., Journal of Metals, Feb. 1983, pp. 52–54.*

"Japanese Industrial Standard, Surface Roughness–Definitions and Designation," JIS B 0601, pp. 1–16, 1994.*

Boy, J., Kmar, A., March, P., Willis, P., and Herman, H., "Cavitation and Erosion–Resistant Thermal Spray Coatings," Construction Productivity Advancement Research (CPAR) Program, Jul. 1997, retrieved from internet on Nov. 14, 2001, url:<http://owww.cecer.army. mil/techparts/boycavit/boycavit.jet.htm.*

"Evaluation of Relative Cavitation Erosion Rates for Base Materials, Weld Overlays, and Coatings," P. March and J. Hubble Report No. WR28–1–900–282, Tennessee Valley Authority Engineering Laboratory, Norris, TN, Sep. 1996.

Deposition Techniques and Heat Transfer Properties of Porous Aluminum, V. J. Silvestri et al, IBM Corporation, New York, J. Electchem. Soc., vol. 129, No. 5, p. 1029, The Electrochemical Society, New Jersey, May, 1982.

Cavitec Anti–Cavitation–Erosion Process [Online]. Eutectic Corp., 2001 [retrieved on Jun. 06, 2001], Retrieved from the Internet: <URL:www.eutectic–usa.com/pdf/cavitec1.pdf>.

Cavitation Resistance of Thermal Spray Coatings [Online]. U.S. Army Corps of Engineers Directorate of Military Programs, 2001 [retrieved on Jun. 6, 2001]. Retrieved from the Internet: <URL:www.hq.usace.army.mil/cemp/e/et/cavitat.pdf>.

* cited by examiner

*Primary Examiner*—Michael S. Brooke

(57) ABSTRACT

A passivation layer for a thermal ink jet printhead is provided. The material of the passivation layer can be a Co-based alloy with 25–30 wt % Cr or an Fe-based alloy with ≦10 wt. % Co, ≦20 wt. % Cr, ≦10 wt. % Mn. The passivation layer is amorphous and the surface is substantially atomically smooth or has a controlled surface roughness. The passivation layer displays resistance to cavitation and chemical corrosion and is conformally disposed over a resistor by sputtering or other physical vapor deposition techniques.

24 Claims, 4 Drawing Sheets

THERMAL INK JET RESISTOR PASSIVATION

BACKGROUND

1. Field of the Invention

The present invention is directed generally to a thermal ink jet printhead. More specifically, the present invention is directed to a passivation layer for a thermal ink jet printhead.

2. Background of the Invention

In a thermal ink jet (TIJ) printhead, ink is projected through an orifice by the repetitive high speed collapse of a vapor bubble created by the resistive heating of a resistor. The implosion of the bubbles can erode the surfaces of the TIJ printhead. This erosion, alternatively called cavitation, can cause failure of jet producing elements, such as a resistor in a thermal ink jet printhead, a protective overcoat, or an underlying substrate. This deleterious effect can be mitigated by a passivation layer covering the area susceptible to cavitation.

An ideal passivation layer for TIJ resistors is resistant to the mechanical stresses during bubble collapse, has a smooth surface topography for a consistent bubble nucleation, and is chemically inert to withstand various operating environments including high and low pH levels from various kinds of inks. Prior improvements in the life expectancy of TIJ printheads have been achieved by the choice of geometry, the materials, and the fluid over the resistor. For example, co-assigned U.S. Pat. No. 4,528,574, the disclosure of which is incorporated herein by reference, uses an acoustic absorber in a TIJ printhead to reduce damage from cavitation.

Traditionally Ta has been used as the top passivation layer material to protect the TaAl resistors from the cavitation damage. However, Ta and Ta alloys suffer from several characteristics that deleteriously impact performance in a thermal ink jet printhead environment.

It is known that to be effective, boiling must occur very reproducibly when heat flux or temperature reach a certain level. A surface that is changing due to, for example, cavitation or corrosion, suffers from a deficiency in stable nucleation sites on the surface. However, known passivation layer materials have not sufficiently resisted cavitation and corrosion over extended use, resulting in a dynamically changing surface topography and reduced performance.

Cavitation remains an industry problem and negatively impacts the life of TIJ printheads. The problems from cavitation are especially acute for large arrays of jets which are more expensive to manufacture and are statistically more prone to failure.

In addition improvements in TIJ technology, such as a semi-permanent TIJ printhead, require improved resistor reliability. The adoption of a high resistivity resistor, with its accompanying higher voltage, also demands stronger passivating materials to prevent arcing that could arise if a crack exists in the dielectric between the resistor and a metallic overcoat.

SUMMARY OF THE INVENTION

Exemplary embodiments of the present invention are directed to a passivation layer for a thermal ink jet printhead that is a corrosion and cavitation resistant thin film, is substantially atomically flat or has a controlled roughness, and is corrosion resistant.

In accordance with exemplary embodiments, a passivation layer for a thermal ink jet printhead is provided. The passivation layer is conformally disposed as an amorphous or pseudo-amorphous layer over a resistor by sputtering or other physical vapor deposition techniques and is in fluid contact with the ink in a thermal ink jet printhead. When substantially atomically flat, the surface roughness of the passivation layer is ≦50 Å, preferably ≦20 Å, and most preferably is ≦10 Å. Alternatively, the passivation layer can have a controlled surface roughness wherein the controlled surface roughness is ≧100 Å.

The material of the passivation layer is disposed as an amorphous or pseudo-amorphous layer of small grain sizes, as small as the nanoscale. Exemplary materials for the thin layer display cavitation and corrosion resistant properties. Suitable materials include Co-based alloys and Fe-based alloys. The Co-based alloys can have 25–30 wt % Cr and optionally ≦5.0 wt % Fe. The Fe-based alloys can have ≦10 wt. % Co, ≦20 wt. % Cr, and ≦10 wt. % Mn. The Co-based and the Fe-based materials exhibit a cavitation rate of less than 7 mg/hour and preferably ≦4 mg/hour.

BRIEF DESCRIPTION OF THE DRAWING FIGURES

Other objects and advantages of the invention will become apparent from the following detailed description of preferred embodiments in connection with the accompanying drawings in which like numerals designate like elements and in which.

DESCRIPTION OF PREFERRED EMBODIMENTS

Figure 1:
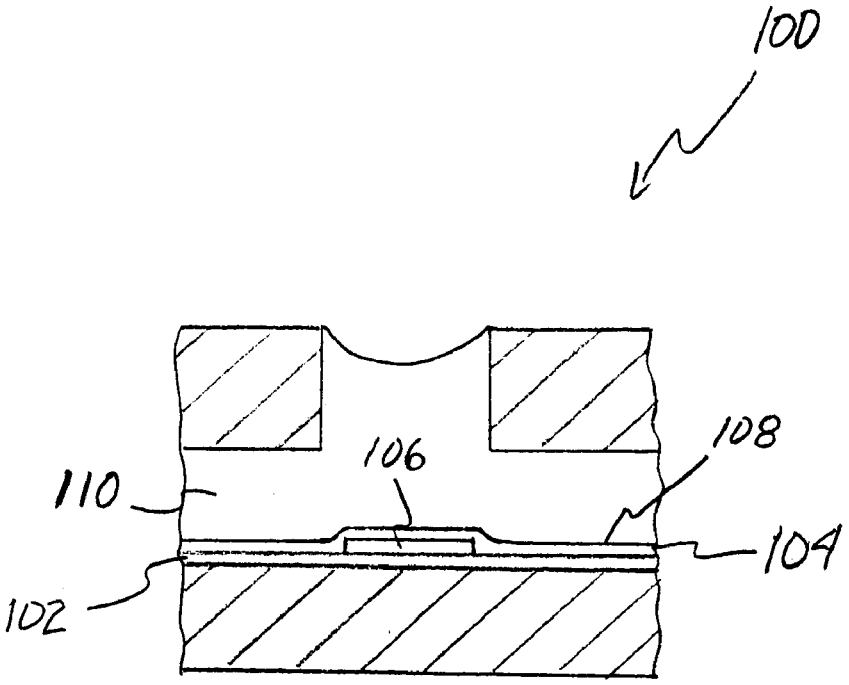
FIG. 1 is a schematic cross section of a thermal ink jet printhead with a passivation layer.

FIG. 1 shows an exemplary embodiment of a printhead 100 with a sequence of sublayers 102 and a passivation layer 104 disposed over a resistor 106. A first surface 108 of the passivation layer 104 is exposed to the ink channel 110 and is in fluid contact with the ink when the printhead 100 is in operation.

The passivation layer 104 is a corrosion and cavitation resistant thin film, is substantially atomically flat or has a controlled roughness, and is corrosion resistant. In the exemplary printhead of FIG. 1, the passivation layer 104 can be a Co-based alloy with 25–30 wt % Cr and optionally ≦5 wt % Fe or an Fe-based alloy with ≦10 wt. % Co, ≦20 wt. % Cr, and ≦10 wt. % Mn.

A specific example of an alloy suitable for the passivation layer 104 is an alloy from the Stellite® family, such as Stellite® 6B available from Deloro Stellite of Belleville, ON, Canada. Other suitable materials for the passivation layer in keeping with the invention include CaviTec® available from Castolin Eutectic Corp of Charlotte, N.C., Stellite® 21 and Tribaloy® T-400 available from Deloro Stellite of Belleville, ON, Canada, and Hydroloy® 914, available from Stoody Deloro Stellite, Inc. of Goshen, Ind. The chemical compositions of some exemplary materials along with 308 Stainless steel are listed in Table 1. Stellite® 6B and Tribaloy® T-400 are cobalt based materials, with ~65% Co content and Hydroloy® 914 and CaviTec® are iron based materials, with ~60% Fe content.

TABLE 1

Chemical compositions of some cavitation resistant materials

| | Fe | C | Mn | Si | Cr | Ni | Co | N | Mo | W |
|---|---|---|---|---|---|---|---|---|---|---|
| 308 Stainless | Bal. | 0.04 | 1.7 | 0.83 | 20 | 8.9 | — | 0.05 | — | — |
| CaviTec ® | Bal. | 0.3 | 10 | 3 | 17 | — | 10 | 0.1 | — | — |
| Hydroloy ® 914 | Bal. | 0.22 | 10 | 4.6 | 17 | 2 | 10 | 0.3 | — | — |
| Stellite ® 6B | 2.07 | 1.22 | 0.3 | 1.1 | 28.61 | 2.23 | Bal. | — | 0.08 | 4.95 |
| Tribaloy ® T-400 | 0.51 | 0.02 | — | 2.61 | 0.77 | 0.32 | Bal. | — | 28.92 | — |

The Co-based alloys are a first exemplary candidate for cavitation resistant material applications. Co-based materials possess hot hardness above 600° C. with excellent wear, galling, corrosion and erosion resistance. Furthermore, wear resistance is inherent and not the result of cold working or heat treatment.

The Fe-based alloys are another exemplary candidate for cavitation resistant material applications. Fe-based materials possess good wear resistance at relatively moderate temperatures.

The passivation layer is a conformally disposed amorphous alloy having a cavitation rate of <7 mg/hour. The cavitation properties of exemplary Co-based and Fe-based alloys are listed below in Table 2. Cavitation rates were determined by a cavitating jet test apparatus used at 4000 psi, details of which may be found in "Evaluation of Relative Cavitation Erosion Rates for Base Materials, Weld Overlays, and Coatings," P. March and J. Hubble, Report No. WR28-1-900-282, Tennessee Valley Authority Engineering Laboratory, Norris, Tenn., September 1996, the contents of which are incorporated herein by reference.

TABLE 2

Cavitation Properties of Select Alloys

| | Cavitation Rate (mg/h) | Comments |
|---|---|---|
| Stellite ® 6B | 2.2 | Wear and ductility with corrosion |
| Stellite ® 21 | 0.9 | Ductility with corrosion resistance |
| Hydoloy ® 914 | 3.7 | Cavitation and erosion resistant |
| CaviTec ® | 0.2 | Cavitation and erosion resistant |

The tensile strength of Co-based alloys are three times higher as compared to Tantalum (Ta), the present cavitation resistant layer. Table 3 compares the tensile strength of Stellite® 6B and Ta.

TABLE 3

Tensile strength properties of Select Stellite ® Alloys

| Material | Tensile Strength (MPa, @ 25° C.) |
|---|---|
| Tantalum | ~350 |
| Stellite ® 6B | 1010 |

Figure 2:
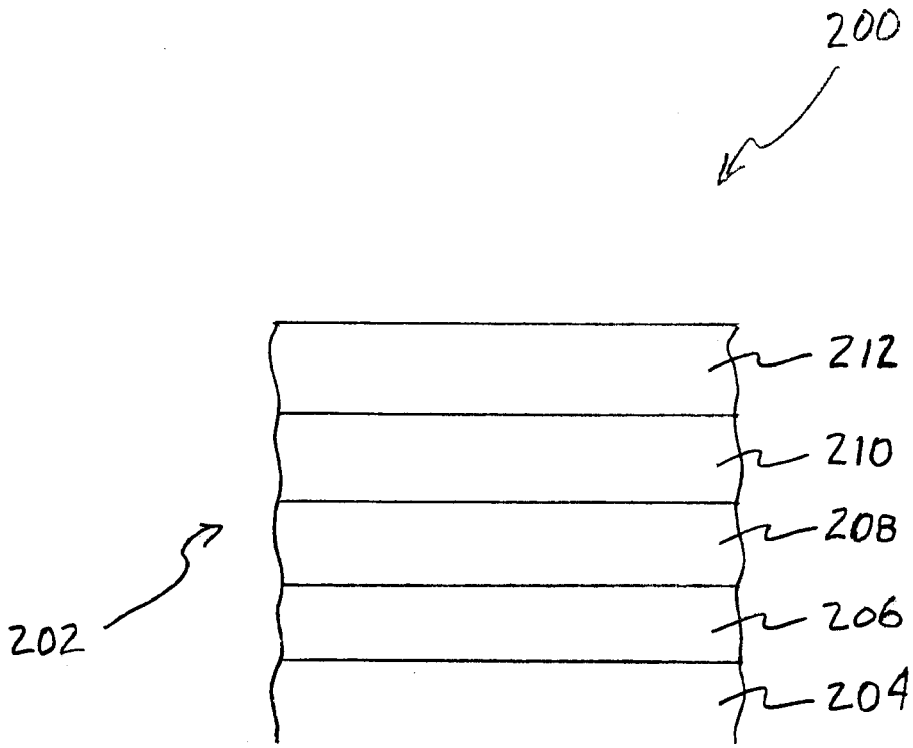
FIG. 2 is a schematic representation of a cross-section of a portion of a thermal ink jet printhead showing a passivation layer and the sequence of sublayers.

FIG. 2 is a schematic representation of a cross-section of a portion of a thermal ink jet printhead showing a passivation structure 200 and the sequence of sublayers 202. In the exemplary embodiment shown, the sublayers 202 are a first dielectric 206 disposed on a resistor 204, a second dielectric 208, an optional Ta layer 210 and the passivation layer 212. Suitable dielectric materials are SiC and SiN. The passivation layer 212 is conformally deposited as a thin film and is the outermost layer from a resistor 204. The passivation layer has a cavitation rate of <7 mg/hour. The passivation layer 212 can be applied by sputtering or other physical vapor deposition techniques, such as ion beam sputtering. In the exemplary embodiment shown in FIG. 2, the passivation layer 212 is 1000 Å to 7000 Å thick and was deposited by thermal sputtering using conventional sputtering parameters from a sputtering target made from a powdered alloy. The total thickness of the sublayers is 0.3–1.5 $\mu$m.

The surface roughness of the passivation layer 212 influences the nucleation dynamics and bubble formation in the TIJ printhead because the surface topography of the top layer is in intimate contact with the ink. A smooth, non-varying surface generates bubbles with consistent energy and bubble size. A rough surface facilitates bubble formation by the presence of a nucleation site, which reduces the energy required to nucleate a bubble. One type of rough surface is a controlled surface. Controlled surfaces can be randomly distributed surface variations of a repeating pattern of surface details. An example of a controlled surface roughness pattern in keeping with the present invention is a concatenated array of angstrom scale cones or pyramids.

A passivation layer in keeping with the exemplary embodiment improves nucleation performance for both smooth, non-varying surfaces and surfaces with controlled surface roughness. A passivation layer with improved cavitation and corrosion resistance results in a more stable and reliable surface for nucleation. By the present invention, cavitation and corrosion resistance has been substantially eliminated allowing for the use of a smooth surface topography or a controlled surface roughness, both of which are substantially unchanging over extended use.

It has been found that multi-component material, such as the terniary Stellite® system or the intermetallic Tribaloy®, tend to form an amorphous or psuedo-amorphous, substantially atomically flat, thin film when deposited by a physical vapor deposition processes. Here, pseudo-amorphous means grain sizes on the nanoscale and an x-ray diffraction pattern represented by a broad (i.e., $2\theta>40°$) single hump. The amorphous character of the Stellite® thin film is preserved at film thicknesses up to approximately 7000 Å.

Figure 3A:
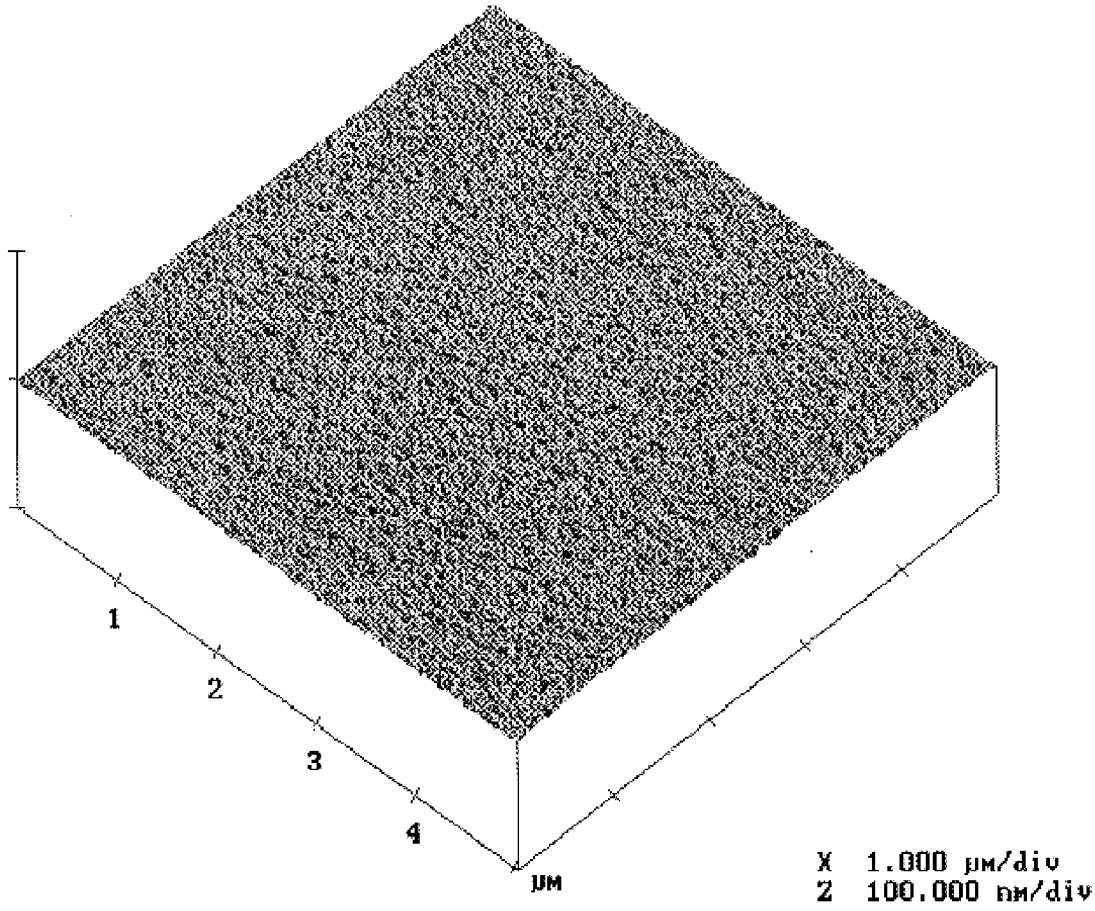
FIGS. 3(*a–b*) are an Atomic Force Microscope (AFM) images of a thin film of (a) Stellite® and (b) Tantalum.
Figure 3B:
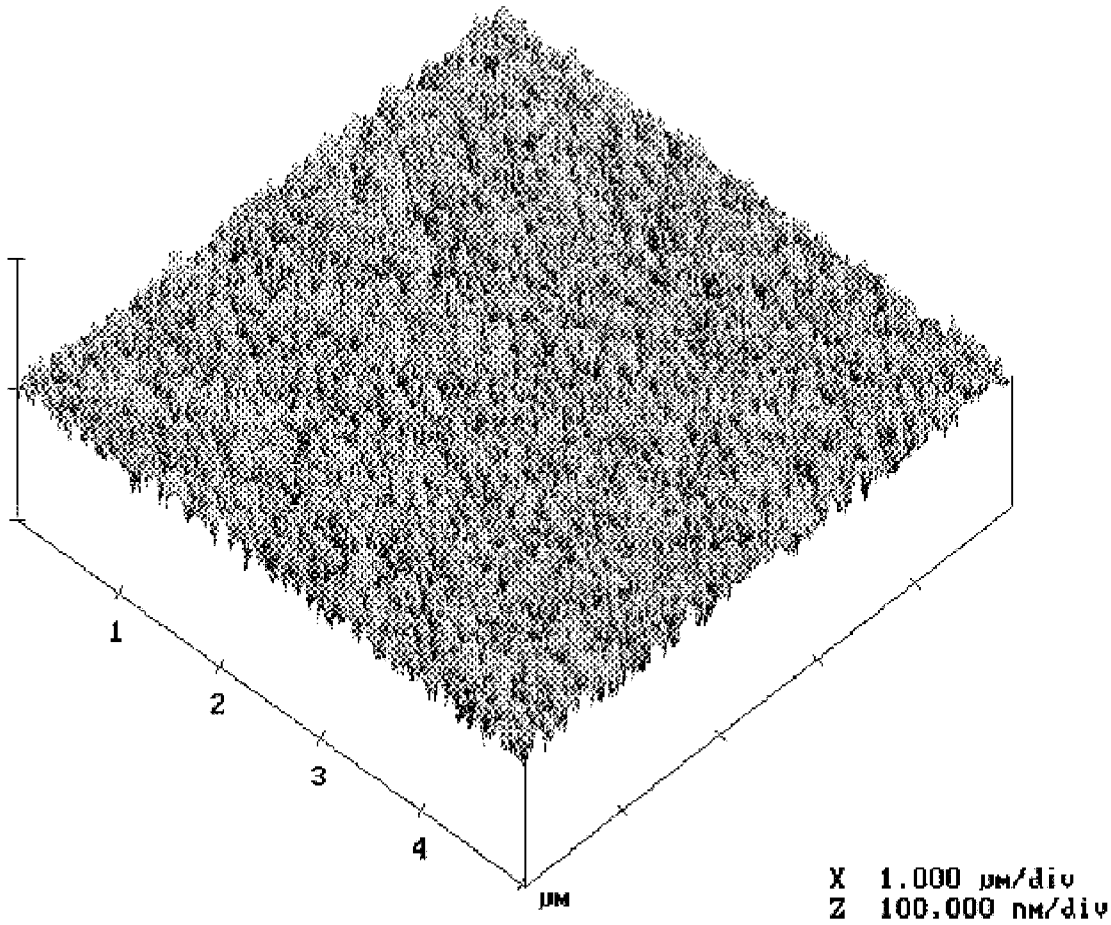

FIG. 3(*a*) shows an atomic force microscope (AFM) image of sputtered Stellite® 6B. FIG. 3(*b*) shows a surface layer of Ta and is provided for comparison. For smooth surface applications, the surface roughness can be <50 Å. AFM measurement on a 5 $\mu$m×5 $\mu$m area shows Stellite® 6B to have a surface roughness of 7 Å, while Ta 51 Å. In a controlled surface roughness application, the passivation layer can have a surface roughness of 100 Å or higher. The surface roughness is a calculated as a rms surface roughness.

The surface of the passivation layer is exposed to the ink channel and is in fluid contact with the ink when the printhead is in operation. The ink used in TIJ printheads contains various chemicals with attendant pH values that range from highly acidic or highly alkaline. Therefore, the passivation layer should show chemical resistance to these environments.

Stellite® thin films were exposed to various chemicals and their etch resistance studied. Table 4 summarizes the various chemical etchants utilized. The Stellite® thin film retained its surface reflectivity after immersion in these etchants for extended times, up to one week, and at elevated temperatures, up to the boiling points of these etchants.

TABLE 4

Selected materials and their etchants

| Material | Etchant |
|---|---|
| W | $HNO_3 + H_2SO_4 + H_2O$ |
| Mo | $H_2O_2 + CH_3COOH + H_2O$ |
| Ni | $HNO_3 + HCl + H_2O$ |
| Mg | $H_2O_2 + H_2O + H_3PO_4$ |
| Fe | $HNO_3 + H_2O$ |
| Si | $HNO_3 + CH_3COOH + HF$ |
| $SiO_2$ | HF |

Stellite® thin films were exposed to an etching environment in both a fluorine-based and a chlorine-based reactive ion etching (RIE) process. Etching studies revealed substantially no etching of the Stellite® thin films in the tested environments. However, material depletion techniques, such as ion beam sputtering techniques, have etched the materials. The corrosion resistant properties of the Stellite® passivation layer are attributed to the amorphous crystal structure.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A structure in a thermal ink jet printhead comprising:

a resistor mounted on a substrate;

at least one sublayer; and a first layer, wherein the first layer is of a conformally disposed amorphous alloy having a cavitation rate of <7 mg/hour, wherein the sublayer consists of Tantalum, the Tantalum sublayer disposed between the resistor and the first layer, and wherein the cavitation rate is determined by a cavitating jet test apparatus used at 4000 psi.

2. The structure of claim 1, wherein the first layer has a cavitation rate of <4 mg/hour.

3. The structure of claim 1, wherein the amorphous alloy is a Co-based or Fe-based alloy.

4. The structure of claim 1, wherein the amorphous alloy is a Co-based alloy comprising 25–30 wt. % Cr and the balance Co.

5. The structure of claim 4, wherein the amorphous alloy further comprises ≦5.0 wt. % Fe.

6. The structure of claim 4, wherein the Co is present in at least 60 wt. %.

7. The structure of claim 1, wherein the amorphous alloy is an Fe-based alloy comprising ≦10 wt. % Co ≦20 wt. % Cr, ≦10 wt. % Mn, and the balance Fe.

8. The structure of claim 1, wherein the first layer is an outermost layer from the resistor and is in fluid contact with an ink in a thermal ink jet printhead.

9. The structure of claim 1, wherein conformally disposed is deposition by a physical vapor deposition technique.

10. The structure of claim 9, wherein the physical vapor deposition technique is sputtering or ion beam sputtering.

11. The structure of claim 1, wherein the first layer has an RMS surface roughness of less than 50 Å.

12. The structure of claim 1, wherein the first layer has a surface roughness of ≦50 Å.

13. The structure of claim 12, wherein the surface roughness is ≦20 Å.

14. The structure of claim 13, wherein the surface roughness is ≦10 Å.

15. The structure of claim 1, wherein the first layer has a controlled surface roughness.

16. The structure of claim 1, comprising at least a first dielectric layer positioned between the resistor and the sublayer of Tantalum.

17. The structure of claim 16, comprising a second dielectric layer positioned between the first dielectric layer and the resistor.

18. A method of providing cavitation resistance to a thermal ink jet printhead comprising the steps of:

applying a sublayer consisting of Tantalum over a thermal ink jet printhead resistor;

disposing a layer of an amorphous alloy having a cavitation resistance of <7 mg/hour over the sublayer, wherein the Tantalum sublayer promotes adhesion of the amorphous alloy layer to the sublayer, and the amorphous alloy layer is conformally disposed as an outermost layer from the resistor, and wherein the cavitation rate is determined by a cavitating jet test apparatus used at 4000 psi.

19. The method of claim 18, wherein the amorphous alloy is a Co-based alloy comprising 25–30 wt. % Cr, optionally ≦5 wt. % Fe, and the balance Co.

20. The method of claim 18, wherein the amorphous alloy is an Fe-based alloy comprising ≦10 wt. % Co ≦20 wt. % Cr, ≦10 wt. % Mn, and the balance Fe.

21. The method of claim 18, wherein conformally disposed is deposition by sputtering or other physical vapor deposition techniques.

22. The method of claim 18, comprising applying at least a first dielectric layer on the resistor between the resistor and the sublayer of Tantalum.

23. The method of claim 22, comprising applying a second dielectric layer between the first dielectric layer and the resistor.

24. The method of claim 18, wherein the amorphous alloy is in fluid communication with an ink of a thermal ink jet printhead.

* * * * *